US012668749B2

(12) United States Patent
Ziegelaar et al.

(10) Patent No.: US 12,668,749 B2
(45) Date of Patent: Jun. 30, 2026

(54) CO-PROCESSING OF RENEWABLE FEEDSTOCKS IN PETROLEUM PROCESSING

(71) Applicant: BP CORPORATION NORTH AMERICA, INC., Houston, TX (US)

(72) Inventors: Paul Ziegelaar, Naperville, IL (US); John Shabaker, Naperville, IL (US); Christoph Schmitz, Naperville, IL (US); Vincent Kispersky, Lisle, IL (US); Nigel Philip Wells, Ashford (GB)

(73) Assignee: BP Corporation North America, Inc., Houston, TX (US)

( * ) Notice: Subject to any disclaimer, the term of this patent is extended or adjusted under 35 U.S.C. 154(b) by 213 days.

(21) Appl. No.: 18/573,654

(22) PCT Filed: Jun. 29, 2022

(86) PCT No.: PCT/US2022/035459

§ 371 (c)(1),
(2) Date: Dec. 22, 2023

(87) PCT Pub. No.: WO2023/278531

PCT Pub. Date: Jan. 5, 2023

(65) Prior Publication Data

US 2024/0301301 A1 Sep. 12, 2024

Related U.S. Application Data

(60) Provisional application No. 63/216,896, filed on Jun. 30, 2021.

(51) Int. Cl.
*C10G 65/12* (2006.01)
*C10G 3/00* (2006.01)
(Continued)

(52) U.S. Cl.
CPC ..... *C10G 65/12* (2013.01); *C10G 3/50* (2013.01); *C10G 45/02* (2013.01); *C10G 45/44* (2013.01);
(Continued)

(58) Field of Classification Search
CPC ..... C10G 65/12; C10G 3/50; C10G 45/02; C10G 45/44; C10G 45/58; C10G 47/22;
(Continued)

(56) References Cited

U.S. PATENT DOCUMENTS 11,326,111 B1 * 5/2022 Koseoglu ..... C10G 65/12
2008/0173570 A1 7/2008 Marchand et al.
(Continued)

FOREIGN PATENT DOCUMENTS

WO 2021/050271 A1 3/2012

OTHER PUBLICATIONS

International Search Report and Written Opinion of International Application No. PCT/US2022/035459 mailed Oct. 7, 2022, 10 pages.

*Primary Examiner* — Prem C Singh
*Assistant Examiner* — Francis C Campanell
(74) *Attorney, Agent, or Firm* — McDonnell Boehnen Hulbert & Berghoff LLP

(57) ABSTRACT

The present disclosure relates generally to processes for handling renewable hydrocarbon feeds and conventional hydrocarbon feeds. One aspect of the disclosure provides a process for co-processing a renewable feed and a petroleum feed, the process comprising: hydrotreating the petroleum feed in a first reaction one, wherein the hydrotreating of the petroleum feed comprises one or more of hydrodesulfurization, hydrodenitrogenation, hydrodemetallization, isomerization, hydrogenation of olefins, and hydrocracking, to form a first reaction zone effluent; conducting the first
(Continued)

reaction zone effluent to a second reaction zone; and in the second reaction zone hydrotreating a combination of the first reaction zone effluent and the renewable feed, wherein the hydrotreating of the combination comprises one or more of hydrodeoxygenation, decarboxylation, decarbonylation, isomerization and hydrogenation of olefins of the renewable feed, to form a second reaction zone effluent.

24 Claims, 1 Drawing Sheet

(51) Int. Cl.

| | |
|---|---|
| ***C10G 45/02*** | (2006.01) |
| ***C10G 45/44*** | (2006.01) |
| ***C10G 45/58*** | (2006.01) |
| ***C10G 47/22*** | (2006.01) |

(52) U.S. Cl.
CPC ..... *C10G 45/58* (2013.01); *C10G 47/22* (2013.01); *C10G 2300/1014* (2013.01)

(58) Field of Classification Search
CPC .... C10G 2300/1014; C10G 2300/1011; C10G 65/02; Y02E 50/10; Y02P 30/20
USPC ..... 585/242
See application file for complete search history.

(56) References Cited

U.S. PATENT DOCUMENTS

| | | | | |
|---|---|---|---|---|
| 2011/0219669 | A1 | 9/2011 | Hanks et al. | |
| 2013/0152459 | A1 | 6/2013 | Banerjee et al. | |
| 2015/0005547 | A1* | 1/2015 | Freel | C10G 3/42 585/14 |
| 2017/0183593 | A1* | 6/2017 | Sandberg | B01J 35/59 |

* cited by examiner

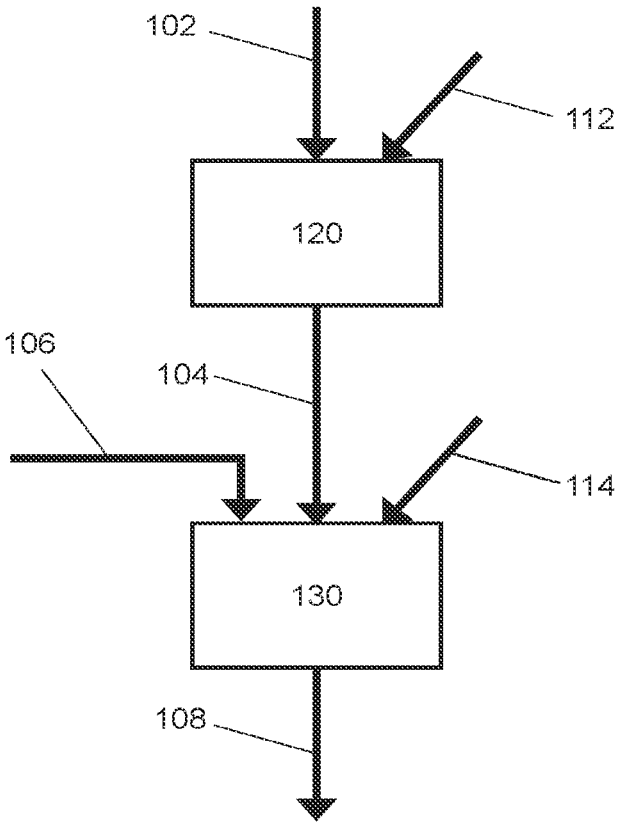
102
112
120
106
104
114
130
108

CO-PROCESSING OF RENEWABLE FEEDSTOCKS IN PETROLEUM PROCESSING

CROSS-REFERENCE TO RELATED APPLICATIONS

This application is a U.S. national phase application of International Patent Application No. PCT/US2022/035459, filed Jun. 29, 2022, which claims the benefit of priority of U.S. Provisional Patent Application No. 63/216,896, filed Jun. 30, 2021, which is hereby incorporated herein by reference in its entirety.

BACKGROUND OF THE DISCLOSURE

Field

The present disclosure relates to processes for handling renewable feedstocks in combination with conventional petroleum feedstocks.

Technical Background

Renewable sources of hydrocarbons are becoming increasingly important as a means of reducing the production of greenhouse gases while also reducing petroleum imports. For example, lignocellulosic biomass is typically made up of cellulose, hemicellulose, and lignin. These biomass components are non-edible, carbohydrate-rich polymers that may serve as a renewable source of energy. They typically make up at least 70% of the dry weight of biomass. As such, conversion of these non-edible biomass components into bio-fuels is of ongoing interest that can benefit the environment and reduce petroleum imports.

Triglycerides and other suitable biologically-derived feedstocks can be converted into transportation fuel components, such as bio-LPG, biogasoline, biojet, biodiesel, HVO and/or biodistillate. Triglycerides often include a range of natural materials formed from esterification of fatty acids and/or glycerol, such as vegetable oils, animal fats, and the like. Coprocessing of natural oils and/or fats with fractions of fossil-derived crude oil can be a convenient way to convert the natural oils and/or fats into a transportation fuel or other useful products.

Similarly, other renewable feedstocks can be converted to more useful products. For example, streams from waste such as pyrolysis oils (e.g., derived from plastic waste) and Fischer-Tropsch waxes might also be candidates for conversion. Here, too, coprocessing can be a convenient way to proceed.

Raw renewable feedstocks such as these must, like petroleum feedstocks, undergo a series of processing steps to remove undesirable components and upgrade the fuel constituents. However, integration of feedstocks derived from renewable sources with processes for processing conventional petroleum-based feedstocks can present significant challenges, given their different provenance and chemistry. These significant challenges remain as complications in the development of methods of co-processing renewable and conventional petroleum feedstocks.

SUMMARY

In a petroleum oil refinery, hydrotreaters perform several chemical conversions and reactions. For example, hydrodesulfurization, hydrodenitrogenation and hydrodemetallization processes can be used to remove undesirable sulfur, nitrogen and metallic components. Reactions such as hydrogenation (e.g., olefin saturation), hydrocracking, deoxygenation, isomerization, and cracking can upgrade fuel components, e.g., by deoxygenation and/or changing hydrocarbon chain length and/or structure. Thus, chemical conversions are useful for upgrading the fuel components and for production of clean and/or low sulfur transportation fuels. These processes utilize hydrogen as a reactant, optionally in combination with one or more other gases, and a catalyst, and are typically performed at elevated temperature and/or pressure. Typical catalysts include zeolites and transition metals (which can be provided, for example, in metallic form, or reduced in situ from an oxidic form).

The present inventors have noted that petroleum feeds and renewable feeds, while both suitable for conversion into fuels and other products, originate from very different sources and can have very different hydrotreating requirements and/or poor mutual compatibility. For example, petroleum feeds tend to have a high amount of sulfur, nitrogen and/or metals. And renewable feeds, especially those based on fatty acid esters, can require significant deoxygenation and olefin saturation in order to provide desirable products. But the present inventors have also recognized that certain efficiencies can be gained by co-processing feedstocks in shared equipment.

The inventors have developed processes to efficiently co-process renewable feedstock alongside conventional petroleum feedstocks.

Thus, one aspect of the disclosure provides a process for co-processing a renewable feed and a petroleum feed, the process comprising:

- hydrotreating the petroleum feed in a first reaction zone, wherein the hydrotreating of the petroleum feed comprises one or more of hydrodesulfurization, hydrodenitrogenation, hydrodemetallization, isomerization, hydrogenation of aromatics, and hydrocracking, to form a first reaction zone effluent;
- conducting the first reaction zone effluent to a second reaction zone; and
- in the second reaction zone hydrotreating a combination of the first reaction zone effluent and the renewable feed, wherein the hydrotreating of the combination comprises one or more of hydrodeoxygenation, decarboxylation, decarbonylation), isomerization and hydrogenation of olefins of the renewable feed, to form a second reaction zone effluent.

Thus, another aspect of the disclosure provides a process for co-processing a renewable feed and a petroleum feed, the process comprising:

- hydrotreating the petroleum feed in a first reaction zone, wherein the hydrotreating of the petroleum feed comprises one or more of hydrodesulfurization, hydrodenitrogenation, hydrodemetallization, hydrogenation of aromatics, and hydrocracking, to form a first reaction zone effluent;
- conducting the first reaction zone effluent to a second reaction zone; and
- in the second reaction zone hydrotreating a combination of the first reaction zone effluent and the renewable feed, wherein the hydrotreating of the combination comprises one or more of hydrodeoxygenation, decarboxylation, decarbonylation), and hydrogenation of olefins of the renewable feed, to form a second reaction zone effluent.

isomerization can be performed in the first reaction zone, the second reaction zone, or both.

Advantageously, the processes described herein allow hydroprocessing of combinations of feeds while minimizing interference with the hydrotreating of the petroleum feed by the renewable feed. In particular, the present inventors have noted that hydrotreating of renewable feedstocks can be significantly exothermic and consume large amount of hydrogen gas. When hydrotreatment of a petroleum feed is performed in combination with a renewable feedstock, this can cause a less effective processing of the petroleum feed. Further, separation of the reaction exotherms and peak $H_2$ consumption allows for increased processing capacity with existing infrastructure. Additionally, separation of certain process steps allows independent reactor design and conditions to be utilized for each. For example, the method of feed introduction, catalyst choice, bed design, temperature controls, and metallurgy may be independently optimized for treatment of a renewable feed, for treatment of a petroleum feed, and/or for treatment of a combination of a renewable feed with a petroleum feed.

Other aspects of the disclosure will be apparent to those skilled in the art in view of the description that follows.

BRIEF DESCRIPTION OF THE DRAWINGS

FIG. 1 provides a process schematic according to one embodiment of the disclosure.

DETAILED DESCRIPTION

The present disclosure relates to processes to allow efficient handling of renewable feedstocks in conjunction with petroleum feedstocks. The present inventors have found that co-processing hydrocarbon feedstocks may have many benefits related to efficiency and capital expenditure. However, the present inventors have noted that simply combining a renewable feed with a petroleum feed at the outset of hydroprocessing can result in certain process inefficiencies. For example, hydroprocessing of renewable feedstocks can result in high hydrogen consumption and strong exotherms due to a high degree of hydrodeoxygenation, decarboxylation, decarbonylation, isomerization and olefin saturation. And processes important for processing of petroleum feeds, especially hydrodesulfurization, hydrodenitrogenation, hydrodemetallization, and hydrogenation of aromatics, can be complicated by the presence of large amounts of renewable feedstock. Accordingly, the present inventors have noted that it can be advantageous to allow the renewable feed to bypass one or more hydroprocessing steps to which a petroleum feed is subjected. After initial hydroprocessing, the petroleum feed and a renewable feed may be combined and co-processed in a downstream reactor.

Accordingly, one aspect of the disclosure provides a process for co-processing a renewable feed and a petroleum feed, the process comprising:

- hydrotreating the petroleum feed in a first reaction zone, wherein the hydrotreating of the petroleum feed comprises one or more of hydrodesulfurization, hydrodenitrogenation, hydrodemetallization, isomerization, hydrogenation of aromatics, and hydrocracking, to form a first reaction zone effluent;
- conducting the first reaction zone effluent to a second reaction zone; and
- in the second reaction zone hydrotreating a combination of the first reaction zone effluent and the renewable feed, wherein the hydrotreating of the combination comprises one or more of hydrodeoxygenation, decarboxylation, decarbonylation, isomerization and hydrogenation of olefins of the renewable feed, to form a second reaction zone effluent.

Such a process is shown in schematic view in FIG. 1. Here, a petroleum feed 102 is conducted to a first reaction zone 120, in which it is hydrotreated (e.g., by one or more of hydrodesulfurization, hydrodenitrogenation, hydrodemetallization, hydrogenation of aromatics, isomerization and hydrocracking), to form a first reaction zone effluent 104. The first reaction zone effluent 104 is conducted to a second reaction zone 130. In the second reaction zone 130, a combination of the first reaction zone effluent 104 and a renewable feed 106 are hydrotreated (e.g., one or more of hydrodeoxygenation, decarboxylation, decarbonylation, isomerization and hydrogenation of olefins of the renewable feed) to form a second reaction zone effluent 108.

In the first reaction zone, the petroleum feed is hydrotreated. Desirably, this hydrotreatment is performed without substantial amounts of renewable feedstock being present. For example, in certain embodiments, the hydrotreatment of the petroleum feed in the first reaction zone is conducted in the presence of no more than 10 wt % renewable material, e.g., no more than 5 wt %. In certain embodiments as otherwise described herein, hydrotreatment of the petroleum feed in the first reaction zone is conducted in the presence of no more than 2 wt % renewable material. e.g., no more than 1 wt %. However, in other embodiments, some amount of renewable material is present; based on the disclosure herein, the person of ordinary skill in the art can determine what amount of renewable material is tolerable in the hydrotreatment of the petroleum feed.

In the first reaction zone, the petroleum feed can be subjected to processes that are generally less important with respect to the renewable feed, and/or that can suffer from inefficiency in the presence of renewable feedstocks. Processes performed in the first reaction zone may be performed in a single reactor or catalyst bed, or in multiple reactors or catalyst beds, arranged in series or in parallel. For example, each process in the first reaction zone may be performed in a separate reactor or catalyst bed. In other embodiments, two or more processes may be performed within a single reactor or compartment. For example, the reactor conditions and reactant feeds may be varied to perform two or more processes.

For example, in certain embodiments, the hydrotreating of the petroleum feed in the first reaction zone includes hydrodesulfurization. Hydrodesulfurization is a hydrotreating process known in the art to reduce the sulfur content of feedstocks. Sulfur exists in feedstocks in a variety of organic and inorganic forms, including thiols, thiophenes, and sulfides, and can lead to undesirable petroleum characteristics and downstream catalyst poisoning. Hydrodesulfurization serves to convert these to a volatile sulfur form, often hydrogen sulfide, which can be captured and transformed into other forms such as sulfuric acid and/or elemental sulfur. The petroleum feed can be contacted with a hydrodesulfurization catalyst (e.g., an alumina-supported CoMo, NiMo, CoW and/or NiW catalyst, typically in a sulfided form) and hydrogen gas at elevated temperature and pressure. For example, a hydrodesulfurization is performed, in certain embodiments, at temperatures in the range of 250-450° C. (e.g., 300-400° C.) and pressures in the range of 1.5-20 MPa (e.g., 3-15 MPa)) absolute. In certain desirable embodiments, the hydrodesulfurization removes at least 50% of sulfur (on an atomic basis) from the petroleum feed. e.g., at least 75%, at least 90%, or even at least 95%.

In certain embodiments, the hydrotreating of the petroleum feed in the first reaction zone includes hydrodenitrogenation. Hydrodenitrogenation is a hydrotreating process known in the art to remove nitrogen compounds from petroleum feedstocks through treatment with hydrogen. Hydrodenitrogenation aims to convert organic nitrogen compounds into ammonia and other volatile components which may be removed. The petroleum feed can be contacted with a hydrodenitrogenation catalyst (e.g., an alumina-supported CoMo catalyst, an alumina-supported NiMo catalyst, or a combination thereof) and hydrogen gas at elevated temperature and pressure. For example, a hydrodenitrogenation is performed, in certain embodiments, at temperatures in the range of 250-450° C. (e.g., 300-400° C.) and pressures in the range of 1.5-20 MPa (e.g., 3-15 MPa) absolute. In many processes, hydrodenitrogenation is performed together with hydrodesulfurization in the same process step. In certain desirable embodiments, the hydrodenitrogenation removes at least 50% of nitrogen (on an atomic basis) from the petroleum feed, e.g., at least 75%, or even at least 90%.

In certain embodiments, the hydrotreating of the petroleum feed in the first reaction zone includes hydrodemetallization. Hydrodemetallization is a hydrotreating process by which metals can be removed from oil feedstocks. Low metal contents are critical to downstream processing in order to avoid catalyst poisoning and adverse environmental effects. For example, hydrodemetallization may serve to reduce the concentration of one or more transition metals, such as nickel, vanadium, and/or iron. Without wishing to be bound by theory, hydrodemetallization can proceed by reducing organometallic compounds to the elemental, zero-valent metals, and/or by removing organic ligands from metals, each leading to precipitation of the metal from the oil feedstock. The petroleum feed can be contacted with a hydrodemetallization catalyst (e.g., an alumina-supported CoMo catalyst, an alumina-supported NiMo catalyst, or a combination thereof) and hydrogen gas at elevated temperature and pressure. For example, a hydrodemetallization is performed, in certain embodiments, at temperatures in the range of 250-450° C. (e.g., 300-400° C.) and pressures in the range of 1.5-20 MPa (e.g., 3-15 MPa) absolute. Of course, other process conditions are possible. In many processes, hydrodemetallization is performed together with hydrodesulfurization and/or hydrodenitrogenation in the same process step. In certain desirable embodiments, the hydrodemetallization removes at least 50 wt % of metals (on an atomic basis) from the petroleum feed, e.g., at least 75 wt %, at least 90%, or even at least 95%.

Moreover, in certain embodiments the process conditions for one or more of hydrodesulfurization, hydrodenitrogenation and hydrodemetallization will, at least to some extent, reduce the amount of asphaltenes in the petroleum feed.

In certain desirable embodiments, the hydrotreating of the petroleum feed in the first reaction zone includes at least one hydrodesulfurization, hydrodemetallization or hydrodenitrogenation, e.g., two or more of hydrodesulfurization, hydrodemetallization or hydrodenitrogenation, or even all three of hydrodesulfurization, hydrodemetallization and hydrodenitrogenation, for example, variously conducted to as to remove species in the amounts as described above, Of course, other hydroprocessing steps can alternatively or additionally be provided in the first reaction zone. For example, in certain embodiments, hydrotreating of the petroleum feed in the first reaction zone includes hydrogenation of aromatics. The petroleum feed can be contacted with a hydrogenation catalyst (e.g., a nickel/tungsten catalyst or a noble metal catalyst) and hydrogen gas at elevated temperature and pressure. For example, a hydrogenation is performed, in certain embodiments, at temperatures in the range of 250-450° C. (e.g., 300-400° C.) and pressures in the range of 5-20 MPa (e.g., 8-15 MPa) absolute. Of course, other conditions can be appropriate in some cases. This can be performed, for example, in a separate reactor or catalyst bed from hydrodesulfurization, hydrodemetallization and/or hydrodenitrogenation, e.g., after such process step(s). In certain desirable embodiments, the hydrogenation of aromatics reduce the aromaticity of the petroleum feed by at least 15%, e.g., at least 30%, as measured by ASTM D6591.

In certain embodiments, hydrotreating of the petroleum feed in the first reaction zone includes hydrocracking. Hydrocracking is a process known in the art to convert high-boiling hydrocarbons into lighter constituents. Hydrocracking formally includes both hydrogenation (e.g., as described above) and cracking; some degree of isomerization is typically present as well. The petroleum feed can be contacted with a hydrocracking catalyst (e.g., a nickel/tungsten catalyst supported on alumina/silica) and hydrogen gas at elevated temperature and pressure. For example, hydrocracking is performed, in certain embodiments, at temperatures in the range of 250-450° C. (e.g., 300-400° C.) and pressures in the range of 5-20 MPa (e.g., 8-15 MPa) absolute. Of course, other conditions are possible. This can be performed, for example, in a separate reactor or catalyst bed from hydrodesulfurization, hydrodemetallization and/or hydrodenitrogenation, e.g., after such process step(s). In certain desirable embodiments, the hydrocracking causes at least 10 wt % of the material (e.g., at least 25 wt %, at least 50 wt %, or at least 75 wt %) to go from having a boiling point at atmospheric pressure greater than 360 C to having a boiling point at atmospheric pressure no more than 360° C., as measured according to ASTM D2887.

In certain embodiments as otherwise described herein, the hydrotreating of the petroleum feed in the first reaction zone includes one or more of hydrodesulfurization, hydrodemetallization and/or hydrodenitrogenation (e.g., two or more or all three as described above), followed by one or more of hydrogenation of aromatics and hydrocracking.

In certain embodiments as otherwise described herein, the hydrotreating of the petroleum feed in the first reaction zone includes isomerization. Isomerization (here, formally a "hydroisomerization") is known to be useful to improve properties of a petroleum feed. e.g., by transforming linear hydrocarbons to branched ones, which can improve the fuel rating (e.g., octane) of an eventual fuel made using the feed, and can help to dewax the feed to improve its cold flow properties. A variety of catalysts and process conditions are known to be suitable for isomerization, depending on the desired transformation. Examples of catalysts include those based on noble metals providing hydrogenation activity (e.g., platinum and palladium) disposed on porous acidic supports, such as ZSM-5, SAPO-11, ZSM-22, Y, and Beta-zeolites and composite materials containing mesoporous MCM-41, MCM-48, and SBA-15. Process conditions are typically in the range of 200-400 C, 1-80 bar $H_2$. The person of ordinary skill in the art will appreciate that other catalysts and/or conditions can be used. In certain desirable embodiments, the isomerization increase the weight ratio of isoparaffins ($C_{10}$-$C_{20}$) to normal paraffins ($C_{10}$-$C_{20}$) by at least 10% (i.e., such that the quotient of the ratio after the isomerization process to the ratio before the isomerization process is at least 110%), for example, at least 20%, as determined by gas chromatography.

In certain embodiments as otherwise described herein, the hydrotreating of the petroleum feed in the first reaction zone includes, in addition to isomerization, one or more of hydrodesulfurization, hydrodemetallization and/or hydrodenitrogenation (e.g., two or more or all three as described above) and/or one or more of hydrogenation of aromatics and hydrocracking.

The petroleum feed can be further subjected to other processing in the first reaction zone, i.e., before combination with the renewable feed. For example, the petroleum feed can be subjected to cracking, visbreaking, coking, and/or reforming in the first reaction zone. Isomerization of the petroleum feed may also be desirable in the first reaction zone, as may alkylation and/or (partial) oxidation. When used, these processes can be performed in any order with respect to the hydroprocessing in the first reaction zone.

The processing of the petroleum feed in the first reaction zone provides a first reaction zone effluent, which is conducted to a second reaction zone. In the second reaction zone, a combination of the first reaction zone effluent and the renewable feed are hydrotreated.

The renewable feed can be subject to a number of operations before it is hydrotreated in combination with the first reaction zone effluent. For example, in certain embodiments, the renewable feed can be isomerized before the hydrotreating in combination with the first reaction zone effluent. The isomerization can, e.g., isomerize fatty acid chains of a fatty acid-based renewable feed. Hydrogenation of olefins of the feed can be performed before the hydrotreating in combination with the first reaction zone effluent, as can some degree of hydrodeoxygenation (as described below) or other reaction to break glyceride ester bonds. And other fat refining processes can be performed on the renewable feed before it is hydrotreated in combination with the first reaction zone effluent.

In certain embodiments, the hydrotreatment of the combination in the second reaction zone includes a hydrodeoxygenation. Hydrodeoxygenation is a process known in the art to remove oxygen from oxygen-containing feedstocks, e.g. triglycerides, through treatment with a reducing gas such as hydrogen. For example, hydrodeoxygenation may remove oxygen from oxygen-containing organic molecules (such as alcohols, ethers, esters, and carbonates) through formation and removal of volatile species such as water. This can be especially important for certain renewable feedstocks. Renewable feedstocks based on fats and oils and/or on lignocellulosic biomass have substantial organic oxygen content; upgrading these species to provide hydrocarbons is highly desirable. The petroleum feed can be contacted with a hydrodeoxygenation catalyst (e.g., an alumina-supported CoMo catalyst, an alumina-supported NiMo catalyst, or a combination thereof) and hydrogen gas at elevated temperature and pressure. For example, a hydrodeoxygenation is performed, in certain embodiments, at temperatures in the range of 250-450° C. (e.g., 300-400° C.) and pressures in the range of 1.5-20 MPa (e.g., 3-15 MPa) absolute. The present inventors have noted that this is similar to the catalyst and conditions used for hydrodesulfurization; however, separating the exothermic hydrodeoxygenation of the renewable feed from the exothermic hydrodesulfurization of the petroleum feed into separate reactors or catalyst beds can be especially advantageous, as it avoids undesirable heat buildup in a single reactor or catalyst bed, and thus presents a lower risk of catalyst deactivation.

In certain embodiments, the hydrotreatment of the combination in the second reaction zone includes one or more of decarboxylation (here, formally a "hydrodecarboxylation") and decarbonylation (here, formally a "hydrodecarbonylation") In a decarboxylation, the hydrotreatment results in the evolution of carbon dioxide from the material. Given that glycerides are formed as carboxylate esters of glycerol and fatty acid, liberation of carbon dioxide with hydrogenation can be an especially powerful way to form long-chain hydrocarbons from the fatty residues of fatty acids and esters in feeds containing them. In a decarbonylation, the hydrotreatment results in the evolution of carbon monoxide from the material. Catalysts and reaction conditions for such processes are known in the art. For example, suitable catalyst for one or both of decarboxylation and decarbonylation include metals such as cobalt, molybdenum, nickel, tungsten, palladium, platinum, iridium, rhodium, rhenium, ruthenium, tin, copper and zinc disposed on an acidic support such as a zeolite or a substituted aluminophosphate; or nickel, cobalt, molybdenum and/or zinc on an alumina support, optionally sulfided. Reaction conditions can vary, but in typical cases are at temperatures in the range of 250-450° C. (e.g., 300-400° C.) and pressures in the range of 1.5-20 MPa (e.g., 3-15 MPa) absolute.

In certain embodiments as otherwise described herein, the hydrotreating of the combination of the first reaction zone effluent and the renewable feed in the second reaction zone includes one or more of hydrodedeoxygenation, decarbonylation and decarboxylation (e.g., two or more or all three). Often, hydrodeoxygenation, decarboxylation and decarbonylation occur together to some extent, with some conditions and catalysts leading to relatively more of one and relatively less of others. All three mechanisms fulfil the desired goal of removing oxygen from the otherwise hydrocarbonaceous molecules of the composition. In certain desirable embodiments, the hydrodedeoxygenation, decarbonylation and/or decarboxylation removes at least 50% of the oxygen from the combination of the first reaction zone effluent and the renewable feed, e.g., at least 75%, at least 90%, at least 95%, or even at least 99%.

In certain embodiments, hydrotreating of the combination in the second reaction zone includes isomerization. Isomerization (here, formally a "hydroisomerization") is known to be useful to improve properties of a renewable feed, e.g., by transforming linear hydrocarbyl species to branched ones, which can improve the fuel rating (e.g., octane) of an eventual fuel made using the feed, and can help to dewax the feed to improve its cold flow properties. A variety of catalysts and process conditions are known to be suitable for isomerization, depending on the desired transformation. Examples of catalysts include those based on noble metals providing hydrogenation activity (e.g., platinum and palladium) disposed on porous acidic supports, such as ZSM-5, SAPO-11, ZSM-22, Y, and Beta-zeolites and composite materials containing mesoporous MCM-41, MCM-48, and SBA-15. Process conditions are typically in the range of 200-400° C., 1-80 bar $H_2$. The person of ordinary skill in the art will appreciate that other catalysts and/or conditions can be used. In certain desirable embodiments, the isomerization increase the weight ratio of iso-paraffins ($C_{10}$-$C_{20}$) to normal paraffins ($C_{10}$-$C_{20}$) by at least 10% (i.e., such that the quotient of the ratio after the isomerization process to the ratio before the isomerization process is at least 110%), for example, at least 20%, as determined by gas chromatography.

In certain embodiments, hydrotreating of the combination in the second reaction zone includes hydrogenation (i.e., at least partially) of olefins of the renewable feed. Many renewable feedstocks retain some olefinic character (e.g., unsaturated fatty acid esters; lignin-containing biomass). The petroleum feed can be contacted with a hydrogenation catalyst (e.g., a NiMo catalyst, a CoMo catalyst, nickel/tungsten catalyst or a noble metal catalyst) and hydrogen gas at elevated temperature and pressure. For example, a hydrogenation is performed, in certain embodiments, at temperatures in the range of 50-450° C. (e.g., 150-400° C.) and hydrogen pressures in the range of 5-20 MPa (e.g., 8-15 MPa) absolute. This can be performed, for example, in a separate reactor or catalyst bed from hydrodeoxygenation, decarboxylation and/or decarbonylation. The process step in which olefins are hydrogenated can also result in hydrogenation of aromatics. In certain desirable embodiments, the hydrogenation of olefins reduces the bromine index of the material by at least 50%, e.g., at least 75%, or at least 90%, or even at least 95%.

The present inventors have noted that the hydrodeoxygenation, decarboxylation, decarbonylation, and hydrogenation of olefins of renewable feeds can often be significantly exothermic. Accordingly, in certain embodiments, one or more hydrotreating operations in the second reaction zone are conducted in parallel, with the renewable feed being split among parallel reactors/catalyst beds in order to spread out the exotherm and hydrogen consumption. The split stream can be recombined for later operations. This can allow for increased processing rate.

Advantageously, the use of a separate reactor zone for hydrotreating of the renewable feed means that the bulk of the petroleum hydrotreating can be performed in reaction systems especially suited for that purpose; indeed, existing petroleum hydrotreating systems can be used without modification. This also allows for separate catalysts and reaction conditions to be used in the first and second reaction zones, to most favor the reactions desired in each. For example, the hydrodeoxygenation, decarboxylation, decarbonylation, and hydrogenation of olefins of the renewable feed can be conducted at substantially lower $H_2$ pressure and/or at lower temperature than the hydrodesulfurization of the petroleum feed. And independent temperature control can be performed in the separate reaction zones, e.g., by intermediate heat exchange, injection of diluents, or management of hydrogen. But the second reaction zone can be designed and operated by the person of ordinary skill in the art to not only perform the desired hydrotreating of the renewable, but also further the hydrotreating of the petroleum feed, i.e., such that the hydrotreating in the first reaction zone need not be pushed to completion. Moreover, cycle management and catalyst change-out strategies can differ between the reaction zones, allowing further increases in process efficiency. Notably, while CoMo catalysts can be advantageous over NiMo catalysts for hydrotreating petroleum feeds, they are strongly inhibited by carbon oxides. By hydrotreating the petroleum feed in the absence of the renewable feed, carbon oxides can be avoided and so the more desirable CoMo catalyst can be used without the inhibition that might occur when a renewable is present.

The hydrogen required for each hydrotreating step can be admitted to reactors/catalyst beds at any desirable point. It can be advantageous to admit hydrogen necessary for the hydrotreating of the renewable feed in the second reaction zone, e.g., at one or more inlets of reactors or catalyst beds therein. This means that a substantial fraction (e.g., at least 50%, at least 75% or even at least 90%) of the hydrogen necessary for the hydrotreating of the renewable feed need not go through the first reaction zone. This can reduce the capacity necessary, and strain on, the compressors delivering hydrogen to the first reaction zone. Requiring less hydrogen in the first reaction zone can also allow for a higher petroleum feed throughput, as reactor space otherwise taken by hydrogen can be filled with petroleum feed. This can also allow for reduced capital expenditure, as smaller compressors and fewer catalysts beds or reactors are necessary in the first reaction zone, as the volume of hydrogen being pushed through the first reaction zone is reduced.

And as the exothermicity of hydrotreating of the renewable feed is not present in the first reaction zone, this allows for a more controlled reaction temperature which avoids suboptimal operating regimes which could lead to less aromatic hydrogenation and an increase in undesirable hydrocracking. Thus better thermal control allows for the reaction temperatures to be separately tuned for each set of reactions.

The second reaction zone effluent can be further processed, as the person of ordinary skill in the art will appreciate. For example, isomerization is a process to generate different isomer distributions within the feedstocks. This can be helpful, e.g., to tune product properties such as oxidative stability, cloud point and viscosity. Cracking (e.g., catalytic or thermal cracking) is a technique known in the art to generate lighter and lower-boiling hydrocarbons from a feed mixture. The person of ordinary skill in the art will select isomerization and/or cracking processes depending on the particular feedstocks used and the desired final product properties. For example, cracking can be used to shift the hydrocarbon length distribution of the product to shorter lengths, e.g., to provide materials with desired boiling range, vapor pressure, etc., such as jet fuel, arctic diesel or gasoline. And some degree of other hydrotreatment effects, e.g., hydrodesulfurization, hydrodemetallization, hydrodenitrogenation, can also occur in the second reaction zone.

The person of ordinary skill in the art can perform the hydrotreating process operations described herein using conventional methodologies. In certain embodiments as otherwise described herein, the treatment gas for each hydrotreating process as otherwise described herein (e.g., the hydrodesulfurization, hydrodenitrogenation, hydrodemetallization, hydrogenation, hydrocracking, hydrodeoxygenation, decarboxylation, decarbonylation) may independently comprise hydrogen. In certain embodiments, the treatment gases as otherwise described herein may be admixed with one or more other gases. For example, in certain embodiments as otherwise described herein the other gases may comprise inert gases, such nitrogen, carbon dioxide, helium, neon, or argon. The inert gases may be present in any suitable amount, for example in the range of 0.1 vol % to 90 vol %. Additionally or alternatively, the other gases may comprise carbon monoxide or water. In certain embodiments, the treatment gases comprise no more than 20 vol % carbon monoxide and water, or no more than 10 vol %, or no more than 5 vol %, or no more than 1 vol % carbon monoxide and water. For example, the treatment gas may comprise substantially no carbon monoxide, and/or may comprise substantially no water. The person of ordinary skill in the art will use any desirable hydrogen source from within an integrated system. For example, reforming processes can provide hydrogen for use in the hydrotreating process steps described herein.

Advantageously, the processes disclosed herein allow for the efficient handling and upgrading of combinations of renewable and petroleum feedstocks. As used herein, a "renewable" feed or material is one that comprises carbon derived from modern biomass (i.e., not biomass that has been converted to petroleum). For example, in certain embodiments, at least 50 wt %, e.g., at least 75 wt %, of the renewable feed is derived from biomass. In certain embodiments as otherwise described herein, at least 90 wt %, e.g., at least 95 wt % or at least 98 wt % or at least 99 wt % of the renewable feed is derived from modern biomass. A variety of biomass sources can be used. One source of biomass is agricultural products in the form of dedicated energy crops such as switchgrass, miscanthus, bamboo, sorghum, tall fescue, kochia, wheatgrass, poplar, willow, silver maple, eastern cottonwood, green ash, black walnut, sweetgum, and sycamore. Another biomass source is agricultural waste or agricultural crop residue. Conventional agricultural activities, including the production of food, feed, fiber, and forest products, generate large amounts of waste plant material. Examples of such materials include corn stover, wheat straw, oat straw, barley straw, sorghum stubble, and rice straw. A third biomass source is through forestry residues left after timber operations. Biomass may also be in the form of municipal waste, which includes commercial and residential garbage, including yard trimmings, paper and paperboard, plastics, rubber, leather, textiles, and food waste. Accordingly, in certain embodiments as otherwise described herein, the renewable feed is derived from agricultural biomass or municipal waste biomass. Additional sources of agricultural biomass will be apparent to one of skill in the art as dictated by local availability, economics, and process compatibility. Municipal waste biomass includes, for example, various classes of municipal solid waste and sewage sludge. Other waste streams can be used. The person of ordinary skill in the art will appreciate that a variety of processes can be used to convert biomass to a desired renewable feed, e.g., via techniques such as pyrolysis and gasification. Transesterification can be used to convert a glyceride into a fatty acid ester such as a fatty acid methyl ester, which can be a suitable renewable feed. In certain embodiments, the renewable feed comprises fatty acyl compounds such as one or more of fatty acids and fatty acid esters such as fatty acid methyl esters and fatty acid glyceride esters. In certain embodiments, the renewable feed comprises lignin, e.g., as lignocellulosic biomass.

Numerous sources of petroleum feeds are known in the art. For example, at least a portion of the petroleum feedstock may be derived from gas, coal, and/or crude oil. Appropriate sources and compositions of conventional feedstocks may be selected by the person of ordinary skill in the art in light of the present disclosure. For example, the petroleum feed may be derived from one or more process streams associated with crude oil refining, such as straight-run fractions, naphtha, kerosene, light gas oil, heavy gas oil, vacuum gas oil, light cycle oil, heavy cycle oil, coker naphtha, visbroken naphtha, coker gas oil, visbroken gas oil and the like, and combinations thereof.

The renewable feed and first reaction zone effluent as otherwise described herein may be provided in any suitable ratio, depending on the desired product(s). For example, in certain embodiments, the renewable feed and first reaction zone effluent are provided in a ratio in the range of 100:1 to 1:100, by weight. In certain embodiments, the renewable feed and first reaction zone effluent are provided in a ratio in the range of 50:1 to 1:50, or 20:1 to 1:20, or 10:1 to 1:10, or 5:1 to 1:5 by weight.

The person of ordinary skill will perform the process steps described here using conventional technologies. In certain embodiments as otherwise described herein, the reaction zones may comprise fixed beds, fluidized beds, ebullated beds, or any other suitable reactor bed. The catalyst may have any suitable particle size. A portion of the catalyst may be withdrawn from the reactor on a continuous basis and/or an intermittent basis to be regenerated or replaced. Catalyst regeneration may occur in a main reaction zone, a separate zone, and/or a separate vessel, and may be performed with hydrogen, water, steam, oxygen, or combinations thereof as appropriate.

In certain embodiments as otherwise described herein, the first reaction zone and second reaction zone form an integrated process. For example, in certain embodiments they can both operate continuously and within the same plant. Within each reaction zone, there may be one or more reactor beds. The first and second reaction zones may be, for example, in separate reactors within the same plant. But in certain embodiments, the first reaction zone and the second reaction zone are formed from different catalyst beds within the same multi-bed reactor Advantageously, the effluent of the second reaction zone may be used to produce valuable products. For example, in certain embodiments as otherwise described herein, the second reaction zone effluent is used to produce one or more of fuels (e.g., distillate fuels), naphtha, gases and lubricant base oils. As noted above, additional process steps may be performed on the effluent of the second reaction zone to provide such products.

Depending on the composition of the renewable feed and the desired process conditions, it may be desirable to dilute a raw renewable feedstock with a diluent in order to after the properties of the renewable feed. In certain embodiments as otherwise described herein, the process may further comprise the step of diluting a raw renewable feedstock with a diluent to form the renewable feed. For example, in particular embodiments, the diluent is a petroleum feed, e.g., in the form of a recycled product oil.

In certain embodiments as otherwise described herein, the effluent streams from one or more reactors from the first and/or second reaction zones may be subjected to vapor/liquid separation to remove volatile components. Separation of vapor and liquid phase components may be achieved through distillation, such as with a distillation tower, a fractionation column, and the like. Optionally or alternatively, flash separation vessels and/or drums may be used instead of, or in addition to, distillation columns. The flash drums can be used where a high proportion of volatile components to liquid components is present, and/or where no separation of the liquid phase into two or more fractions is desired. Flash separation may be carried out prior to product distillation. The vapor phase separated may possess unreacted gases (e.g., unreacted hydrogen). In certain embodiments as otherwise described herein, the vapor phase separated from the liquid phase may be recycled to a reactor or reaction zone. A purge stream may be removed from the vapor phase before recycling to control the levels of contaminants, such as hydrogen sulfide, carbon monoxide, carbon dioxide, ammonia, methane, ethane, propane, nitrogen and nitrogen oxides, and the like. The contaminants may affect reaction rates, deactivate or poison catalysts, and/or form relatively inert components that act as diluents. In other embodiments, the vapor phase is subjected to one or more scrubbing step prior to recycling. The person of ordinary skill in the art can use conventional separation and recycle techniques in practice of the processes described herein.

As certain hydroprocessing reactions can be strongly exothermic, in certain embodiments interstage cooling may be employed. Interstage cooling may include one or more heat transfer devices (e.g., heat exchangers) between catalyst beds. At least a portion of any heat recovered may be recycled to other processes. For example, one or more feeds may be preheated by the heat recovered from the hydroprocessing reactors. Introduction of cold feed may also be used for cooling. The person of ordinary skill in the art will appreciate that other heat transfer techniques can be advantageously used in the processes described herein All percentages, ratios and proportions herein are by weight, unless otherwise specified. The phrase "at least a portion" as used herein is used to signify that, at least, a fractional amount is required, up to the entire possible amount.

Various aspects and embodiments of the disclosure are provided by the following enumerated embodiments, which may be combined in any number and in any combination that is not technically or logically inconsistent.

Embodiment 1. A process for co-processing a renewable feed and a petroleum feed, the process comprising:

hydrotreating the petroleum feed in a first reaction zone, wherein the hydrotreating of the petroleum feed comprises one or more of hydrodesulfurization, hydrodenitrogenation, hydrodemetallization, isomerization, hydrogenation of aromatics, and hydrocracking, to form a first reaction zone effluent;

conducting the first reaction zone effluent to a second reaction zone; and in the second reaction zone hydrotreating a combination of the first reaction zone effluent and the renewable feed, wherein the hydrotreating of the combination comprises one or more of hydrodeoxygenation, decarboxylation, decarbonylation, isomerization and hydrogenation of olefins of the renewable feed, to form a second reaction zone effluent.

Embodiment 2. The process according to embodiment 1, wherein the hydrotreating of the petroleum feed in the first reaction zone is conducted in the presence of no more than 10 wt % renewable material. e.g., no more than 5 wt %.

Embodiment 3. The process according to embodiment 1, wherein the hydrotreating of the petroleum feed in the first reaction zone is conducted in the presence of no more than 2 wt % renewable material, e.g., no more than 1 wt %.

Embodiment 4. The process of any of embodiments 1-3, wherein the hydrotreating of the petroleum feed in the first reaction zone comprises at least one of (e.g., two or more of or all three of) hydrodesulfurization, hydrodemetallization or hydrodenitrogenation.

Embodiment 5. The process of any of embodiments 1-4, wherein the hydrotreating of the petroleum feed in the first reaction zone comprises hydrodesulfurization, for example, so as to remove at least 50% of sulfur from the petroleum feed, e.g., at least 75%, at least 90%, or even at least 95%.

Embodiment 6. The process of any of embodiments 1-5, wherein the hydrotreating of the petroleum feed in the first reaction zone comprises hydrodenitrogenation, for example, so as to remove at least 50% of nitrogen from the petroleum feed, e.g., at least 75%, or even at least 90%.

Embodiment 7. The process of any of embodiments 1-6, wherein the hydrotreating of the petroleum feed in the first reaction zone comprises hydrodemetallization, for example, so as to remove at least 50 wt % of metals from the petroleum feed, e.g., at least 75 wt %, at least 90%, or even at least 95%.

Embodiment 8. The process of any of embodiments 1-7 wherein the hydrotreating of the petroleum feed in the first reaction zone comprises at least one of hydrogenation of aromatics and hydrocracking.

Embodiment 9. The process of any of embodiments 1-8, wherein the hydrotreating of the petroleum feed in the first reaction zone comprises hydrogenation of aromatics, for example, so as to reduce the aromaticity of the petroleum feed by at least 15%, e.g., at least 30%.

Embodiment 10. The process of any of embodiments 1-9, wherein the hydrotreating of the petroleum feed in the first reaction zone comprises hydrocracking, for example, so as to cause at least 10 wt % of the material (e.g., at least 25 wt %, at least 50 wt %, or at least 75 wt %) to go from having a boiling point at atmospheric pressure greater than 360° C. to having a boiling point at atmospheric pressure no more than 360° C.

Embodiment 11. The process of any of embodiments 1-11, wherein the hydrotreating of the petroleum feed in the first reaction zone includes one or more of hydrodesulfurization, hydrodemetallization and/or hydrodenitrogenation (e.g., two or more or all three as described above), followed by one or more of hydrogenation and hydrocracking.

Embodiment 12. The process of any of embodiments 1-11, wherein the hydrotreating of the petroleum feed in the first reaction zone includes isomerization, e.g., so as increase the weight ratio of iso-paraffins ($C_{10}$-$C_{20}$) to normal paraffins ($C_{10}$-$C_{20}$) by at least 10%, for example, at least 20%.

Embodiment 13. The process of any of embodiments 1-12, wherein the hydrotreating of the petroleum feed in the first reaction zone includes, in addition to isomerization, one or more of hydrodesulfurization, hydrodemetallization and/or hydrodenitrogenation (e.g., two or more or all three as described above) and/or one or more of hydrogenation of aromatics and hydrocracking.

Embodiment 14. The process of any of embodiments 1-13, wherein the hydrotreating of the combination in the second reaction zone comprises one or more of hydrodeoxygenation, decarboxylation and decarbonylation.

Embodiment 15. The process of any of embodiments 1-13, wherein the hydrotreating of the combination in the second reaction zone comprises two or more of (e.g., each of) hydrodeoxygenation, decarboxylation and decarbonylation.

Embodiment 16. The process of embodiment 13 or embodiment 14, wherein the one or more of hydrodeoxygenation, decarboxylation and decarbonylation removes at least 50% of the oxygen from the combination of the first reaction zone effluent and the renewable feed, e.g., at least 75%, at least 90%, at least 95%, or even at least 99%.

Embodiment 17. The process of any of embodiments 1-16, wherein the hydrotreating of the combination in the second reaction zone includes isomerization, e.g., so as increase the weight ratio of iso-paraffins ($C_{10}$-$C_{20}$) to normal paraffins ($C_{10}$-$C_{20}$), by at least 10%, for example, at least 20% Embodiment 18. The process of any of embodiments 1-17, wherein the hydrotreating of the combination in the second reaction zone includes hydrogenation of olefins of the renewable feed, for example, so as to reduce the olefinic character of the combination by at least 50%, e.g., at least 75%.

Embodiment 19. The process of any of embodiments 1-18, wherein the second reaction zone effluent is subjected to further process operations comprising cracking (e.g., catalytic or thermal cracking).

Embodiment 20. The process of any of embodiments 1-19, wherein at least 50 wt %, e.g., at least 75 wt %, of the renewable feed is derived from modern biomass.

Embodiment 21. The process of any of embodiments 1-19, wherein at least 90 wt %, e.g., at least 95 wt % or at least 98 wt % or at least 99 wt % of the renewable feed is derived from modern biomass.

Embodiment 22. The process of any of embodiments 1-21, wherein the renewable feed comprises fatty acyl compounds such as one or more of fatty acids and fatty acid esters such as fatty acid methyl esters and fatty acid glyceride esters.

Embodiment 23. The process of any of embodiments 1-21, wherein the renewable feed comprises lignin, e.g., as lignocellulosic biomass.

Embodiment 24. The process of any of embodiments 1-23, wherein the renewable feed and first reaction zone effluent are combined in a ratio in the range of 100:1 to 1:100, by weight.

Embodiment 25. The process of any of embodiments 1-24, wherein the first reaction zone and second reaction zone form an integrated process.

Embodiment 26. The process of any of embodiments 1-25, wherein the second reaction zone effluent is used to produce one or more of fuels, naphtha, gases, and lubricant base oils.

Embodiment 27. The process of any of embodiments 1-26, further comprising the step of diluting a raw renewable feedstock with a diluent to form the renewable feed.

Embodiment 28. The process of embodiment 27, wherein the diluent is petroleum oil, recycled product oil, or a mixture thereof.

Embodiment 29. The process of any of embodiments 1-28, wherein the hydrotreating of the petroleum feed comprises one or more of hydrodesulfurization, hydrodenitrogenation, hydrodemetallization, hydrogenation of aromatics, and hydrocracking; and wherein the hydrotreating of the combination comprises one or more of hydrodeoxygenation, decarboxylation, decarbonylation, and hydrogenation of olefins of the renewable feed.

In closing, it is to be understood that the various embodiments herein are illustrative of the methods of the disclosures. Other modifications that may be employed are within the scope of the disclosure. Thus, by way of example, but not of limitation, alternative configurations of the methods may be utilized in accordance with the teachings herein. Accordingly, the methods of the present disclosure are not limited to that precisely as shown and described.

We claim:

1. A process for co-processing a renewable feed and a petroleum feed, the process comprising:

hydrotreating the petroleum feed in a first reaction zone, wherein the hydrotreating of the petroleum feed comprises one or more of hydrodesulfurization, hydrodenitrogenation, hydrodemetallization, isomerization, hydrogenation of aromatics, and hydrocracking, to form a first reaction zone effluent;

conducting the first reaction zone effluent to a second reaction zone; and in the second reaction zone hydrotreating a combination of the first reaction zone effluent and the renewable feed, wherein the hydrotreating of the combination comprises one or more of hydrodeoxygenation, decarboxylation, decarbonylation, isomerization and hydrogenation of olefins of the renewable feed, to form a second reaction zone effluent, wherein at least 75% of the hydrogen necessary for the hydrotreating in the second reaction zone does not go through the first reaction zone.

2. The process according to claim 1, wherein the hydrotreating of the petroleum feed in the first reaction zone is conducted in the presence of no more than 2 wt % renewable material.

3. The process of claim 1, wherein the hydrotreating of the petroleum feed in the first reaction zone comprises hydrodesulfurization, so as to remove at least 50% of sulfur from the petroleum feed.

4. The process of claim 1, wherein the hydrotreating of the petroleum feed in the first reaction zone comprises hydrodenitrogenation, so as to remove at least 50% of nitrogen from the petroleum feed.

5. The process of claim 1, wherein the hydrotreating of the petroleum feed in the first reaction zone comprises hydrodemetallization, so as to remove at least 50 wt % of metals from the petroleum feed.

6. The process of claim 1, wherein the hydrotreating of the petroleum feed in the first reaction zone comprises hydrogenation of aromatics, so as to reduce the aromaticity of the petroleum feed by at least 15%.

7. The process of claim 1, wherein the hydrotreating of the petroleum feed in the first reaction zone comprises hydrocracking, so as to cause at least 25 wt % of the material to go from having a boiling point at atmospheric pressure greater than 360° C. to having a boiling point at atmospheric pressure no more than 360° C.

8. The process of claim 1, wherein the hydrotreating of the petroleum feed in the first reaction zone includes one or more of hydrodesulfurization, hydrodemetallization and/or hydrodenitrogenation, followed by one or more of hydrogenation and hydrocracking.

9. The process of claim 1, wherein the hydrotreating of the petroleum feed in the first reaction zone includes isomerization, so as increase the weight ratio of iso-paraffins ($C_{10}$-$C_{20}$) to normal paraffins ($C_{10}$-$C_{20}$) by at least 20%.

10. The process of claim 1, wherein the hydrotreating of the petroleum feed in the first reaction zone includes, in addition to isomerization, one or more of hydrodesulfurization, hydrodemetallization and/or hydrodenitrogenation and/or one or more of hydrogenation of aromatics and hydrocracking.

11. The process of claim 1, wherein the hydrotreating of the combination in the second reaction zone comprises one or more of hydrodeoxygenation, decarboxylation and decarbonylation.

12. The process of claim 1, wherein the hydrotreating of the combination in the second reaction zone comprises two or more of hydrodeoxygenation, decarboxylation and decarbonylation.

13. The process of claim 11, wherein the one or more of hydrodeoxygenation, decarboxylation and decarbonylation removes at least 50% of the oxygen from the combination of the first reaction zone effluent and the renewable feed.

14. The process of claim 1 wherein the hydrotreating of the combination in the second reaction zone includes isomerization, so as increase the weight ratio of iso-paraffins ($C_{10}$-$C_{20}$) to normal paraffins ($C_{10}$-$C_{20}$) by at least 20%.

15. The process of claim 1, wherein the hydrotreating of the combination in the second reaction zone includes hydrogenation of olefins of the renewable feed, so as to reduce the olefinic character of the combination by at least 50%.

16. The process of claim 1, wherein the second reaction zone effluent is subjected to further process operations comprising cracking.

17. The process of claim 1, wherein at least 50 wt % of the renewable feed is derived from modern biomass.

18. The process of claim 1, wherein the renewable feed comprises fatty acyl compounds.

19. The process of claim 1, wherein the renewable feed comprises lignin.

20. The process of claim 1, wherein the renewable feed and first reaction zone effluent are combined in a ratio in the range of 100:1 to 1:100, by weight.

21. The process of claim 1, wherein the first reaction zone and second reaction zone form an integrated process.

22. The process of claim 1, wherein the second reaction zone effluent is used to produce one or more of fuels, naphtha, gases, and lubricant base oils.

23. The process of claim 1, wherein the hydrotreating of the petroleum feed comprises one or more of hydrodesulfurization, hydrodenitrogenation, hydrodemetallization, hydrogenation of aromatics, and hydrocracking; and wherein the hydrotreating of the combination comprises one or more of hydrodeoxygenation, decarboxylation, decarbonylation, and hydrogenation of olefins of the renewable feed.

24. The process of claim 1, wherein at least 90% of the of the hydrogen necessary for the hydrotreating in the second reaction zone does not go through the first reaction zone.

* * * * *